US005957387A

United States Patent [19]

Porta et al.

[11] Patent Number: 5,957,387

[45] Date of Patent: Sep. 28, 1999

[54] HYDRAULIC NOZZLE USED ESPECIALLY AS A SHOWER ATTACHMENT, WITH SPRAYER COMPRISING A CHAMBER FOR MIXING TOILET PRODUCTS IN TABLET FORM WITH WATER

[76] Inventors: Giovanni Porta; Paolo Luca Porta, both of Via Strada Padana 20 - 20013, Magenta, Italy

[21] Appl. No.: 08/586,669

[22] PCT Filed: Nov. 10, 1993

[86] PCT No.: PCT/IT93/00117

§ 371 Date: Jan. 16, 1996

§ 102(e) Date: Jan. 16, 1996

[87] PCT Pub. No.: WO95/03892

PCT Pub. Date: Feb. 9, 1995

[30] Foreign Application Priority Data

Jul. 27, 1993 [IT] Italy ..... MI93A1674

[51] Int. Cl.[6] ..... B05B 7/26; B05B 9/00

[52] U.S. Cl. ..... 239/312; 239/310; 239/315; 239/324; 239/437; 239/541

[58] Field of Search ..... 239/302, 310, 239/312, 315, 320, 324, 390, 391, 394, 436, 437, 458, 541

[56] References Cited

U.S. PATENT DOCUMENTS

| | | | |
|---|---|---|---|
| 1,650,460 | 11/1927 | Morgan et al. | 239/315 |
| 1,945,701 | 2/1934 | Pearl | 239/312 |
| 2,069,833 | 2/1937 | Horner | 239/312 |
| 2,537,790 | 1/1951 | Sage | 239/315 |
| 2,603,805 | 7/1952 | Maestas | 239/315 |
| 2,986,340 | 5/1961 | Webb | 239/315 |
| 3,018,696 | 1/1962 | Gentry | 239/312 |
| 3,777,982 | 12/1973 | Britton | 239/315 |

*Primary Examiner*—Andres Kashnikow
*Assistant Examiner*—Robin O. Evans
*Attorney, Agent, or Firm*—Michael J. Striker

[57] ABSTRACT

Nozzle (10) for showers with a sprayer (30) comprising a mixing chamber (51) in which is placed a soluble toilet product in tablet form (80), replaceable, said chamber being connected to said nozzle (10) by a pair of threads on the sides which, on rotating said sprayer (30) in one direction or the other, cause the chamber to move axially between a washing position when water passes through said mixing chamber (51) and dissolves the toilet product (80), and a rinsing position when the water passes through an annular chamber (32) that surrounds said mixing chamber (51).

6 Claims, 3 Drawing Sheets

HYDRAULIC NOZZLE USED ESPECIALLY AS A SHOWER ATTACHMENT, WITH SPRAYER COMPRISING A CHAMBER FOR MIXING TOILET PRODUCTS IN TABLET FORM WITH WATER

BACKGROUND OF THE INVENTION

The present invention relates to accessories for bathrooms, in this case the nozzles applied to showers with sprayers that transform the pressurised jet of water into a fine rain to be regulated and directed as desired.

The user can either freshen up by simply allowing the spray to run pleasingly over the body or can use it for a real wash spreading detergent preparations over the skin by hand.

Allowing for the relative positions of sprayer and user as well as the shape of a shower cubicle, the difficulty of satisfactorily combining washing the skin with detergent and running the water is well known; this includes turning taps on and off, opening and closing the detergent and then once again adjusting water heat and flow. The above invention avoids these drawbacks and ensures a more comfortable shower as will be explained below.

SUMMARY OF THE INVENTION

Accordingly, it is an object of the present invention to provide a nozzle for shower baths that comprises a sprayer substantially cup-shaped creating a mixing chamber through which the water passes, accessible from outside for insertion of some kind of toilet preparation.

In this way the water comes out already mixed with the detergent preparation which no longer need be applied by hand to the skin.

Said detergent, placed in the chamber inside the sprayer, may advantageously be in the form of a tablet.

The chamber is closed at the front by a cylindrical head with a perforated base through which water is sprayed. Inside said head is a plate with a spacer on which the detergent is placed. The purpose of this is to permit a regular flow of water mixed with detergent between the plate and the base, and down through the perforations. Said head is screwed onto the sprayer by threading on the outer face of the head and on the inner face of the sprayer. By simply unscrewing the above head the preferred quantity of bath detergent can be put in.

The nozzle here described comprises means for regulating the sprayer in either of two positions, for 'washing' or for 'rinsing'.

When in the washing position the water passes through the chamber and is mixed with the detergent inside. When in the rinsing position the water flows through passages outside said chamber.

In a preferred execution the nozzle is cup-shaped with a cylindrical body and axial hole in its base fitted externally with a threaded collar for screwing onto the end of a pipe leading in from the water mains.

Inside the cup formed by the nozzle is the sprayer and flow deflector. In addition to the central chamber closed at the front by the cylindrical head, the sprayer comprises an annular chamber, around the central one, open behind. The wall of the nozzle's cylindrical body penetrates inside said annular chamber. Said wall is thin and its inner diameter is greater than the lesser diameter of the annular chamber of the sprayer.

A cavity is thus created through which passes water down to the bottom facing outwards and perforated for spraying.

In the base of the sprayer is a tapered axial expansion that faces towards the nozzle and comprises an axial hole. The flow deflector comprises an upper discoid base, perforated for the passage of water, and a lower head with a tapered back whose diameter is greater than that of the nozzle's axial hole, said lower head being connected to the discoid base by an axial stem that passes through the axial hole in the sprayer.

The diameter of said stem is less than the diameter of said axial hole to allow water to pass.

The base of the flow deflector rests on the annular seat of the nozzle's axial hole.

The tapered head lies inside the sprayer's central chamber. The distance between the base of the nozzle and the tapered back of the deflector head is appreciably greater than the thickness of the base of the sprayer at the point of its tapered expansion so as to permit axial movement of the sprayer to one or other of the two positions, 'washing' and 'rinsing' respectively, towards the nozzle or outside it. In the washing position contact is made between the lower edge of the nozzle's axial hole and opening of a passage between the lower edge of the sprayer's axial hole and the deflector head's tapered back.

Water arriving from the main pipe therefore passes through the holes in the discoid base of the deflector, through the nozzle's axial hole and through that of the sprayer and enters the mixing chamber closed by the cylindrical head; it then passes out through the holes at the bottom mixed with the toilet product already in said chamber. In the rinsing position contact is made between the lower edge of the sprayer's axial hole and the tapered back of the flow deflector's head, and a passage is opened between the top of the sprayer and the base of the nozzle. Water arriving from the main pipe therefore enters the cavity between the nozzle and the sprayer, and emerges from the holes at the bottom of said cavity without any contact with the detergent in the sprayer chamber.

Preferably the sprayer is connected to the nozzle by a pair of threads, of short pitch and wide thread, on the opposing cylindrical faces, respectively the outer face of the nozzle and the larger face of the sprayer's annular chamber, so that by turning this latter on its axis, the threads cause it to make an axial movement.

According to the device's execution, toilet products may consist of a powder, a tablet or take some other form. Preferably the product is generally speaking composed as follows:

Surface active agents 25%
Mineral salts 60–62%
Natural active principles 10–12%
Natural perfume 3%

An optimum formula is given in greater detail below.

Some or all of the various components may be included; some may be replaced by others.

The percentages may be varied according to specific uses, to industrial requirements and to the user's preference.

Empicol LZP 20%
Ammonyx 4002 3%
Sodium chloride FU 17%
Sodium bicarbonate FU 20%
Magnesium sulphate FU 20%
Magnesium chloride FU 10%
Potassium chloride 7%
Natural perfume 3%

The invention possesses some evident advantages. Washing under this shower is more effective, easier and more comfortable.

Insertion of the tablet or other toilet product in the chamber of the sprayer is extremely simple it being sufficient to turn the knurled head.

Once the tablet has been inserted, washing under the shower merely involves turning on the taps since, when passing through the chamber, the water is automatically mixed with the detergent product, providing a refreshing, or even remedial effect if needed, and acting directly on the skin.

To stop the flow the sprayer is rotated once more to restore the water to its natural state, all this being of great relief and comfort to the user.

The composition of the tablet is specifically suited to the characteristics of a sprayer, facilitating rapid mixing with the water and conferring beneficial effects on the person taking the shower bath.

Characteristics and purposes of the invention will be made still clearer by the following example of its execution illustrated with diagrammatically drawn figures.

DESCRIPTION OF PREFERRED EMBODIMENTS

Figure 1:
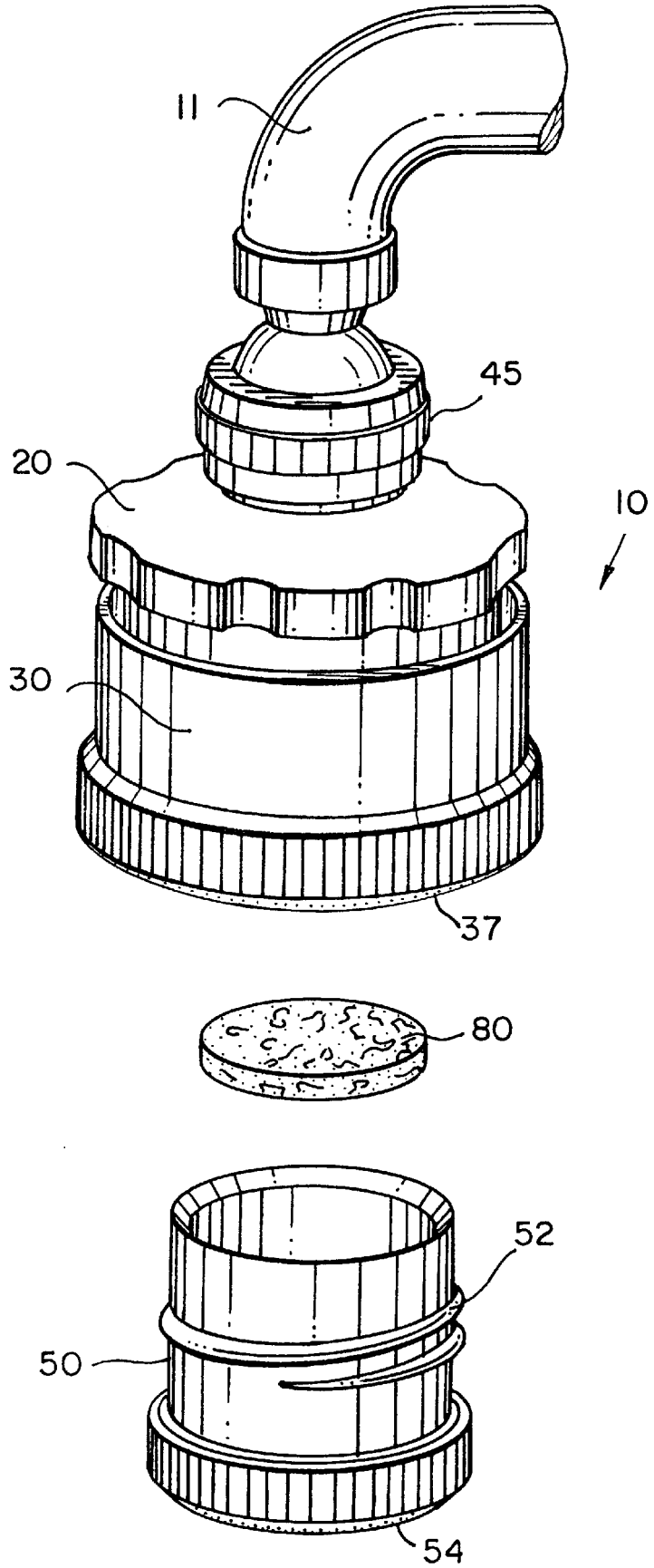
FIG. 1 The nozzle for showers subject of the invention with mixing head taken off; perspective view.

The nozzle 10 for shower baths has a cup-shaped body 20 with cylindrical sides 22 to be screwed onto the end of the main water pipe 11 by means of the threaded ring nut 45, and comprises the sprayer 30 with its head 50 and chamber 51, in which a tablet 80 of toilet detergent is to be mixed, and a flow deflector 60. Said nozzle 10 has a collar 21 with threading 27 and, on the outside of its cylindrical body 22, a wide thread 23 and an annular seat for a washer 25.

Inside the above collar 21 a hole 17 is formed with an annular seat 26 for the base 61 of the flow deflector 60. The sprayer 30 has a cylindrical body 31 with an outer annular chamber 32 and an inner chamber 33.

The annular chamber 32 has two parallel cylindrical walls, a larger one 34 and a smaller one 35.

The wall 34 has a thread 36 for screwing onto the thread 23 of the nozzle 10.

The bottom of the annular chamber 32 contains a number of perforations 37 and 38 through which water is sprayed.

Close to the edges of the inner chamber 33 is a wide-type thread 39.

At the top of the sprayer 30 is a base 40 with a tapered expansion 42 and an axial hole 41.

Inside the sprayer 30 is the cylindrical head 50 comprising a chamber 51 with external threading 52 to screw onto the threading 39 of the inner chamber 33 of the sprayer 30. The bottom 53 of said head 50 is perforated by a set of concentric holes 54 through which water sprays out.

The external diameter of the cylindrical wall 35 of the annular chamber 32 in the body 31 of the sprayer 30 is less than that of the inner wall 19 of the cylindrical body 22 of the nozzle 10 so that a cavity 12 is formed allowing water to flow through.

Passing centrally through the bottom 53 of the head 50 is a threaded hole 55 for the threaded stem 71 of the plate 70 with spacer 72 that creates a space between the charge of detergent, more especially of a tablet 80, and the set of holes 54.

The flow deflector 60 consists of a base 61, stem 62 and tapered head 63.

A set of holes 66 are made through the base 61. In said stem 62 is a threaded hole to take a screw 13 and head 14 for fixing the tapered head 63 in place.

Figure 2:
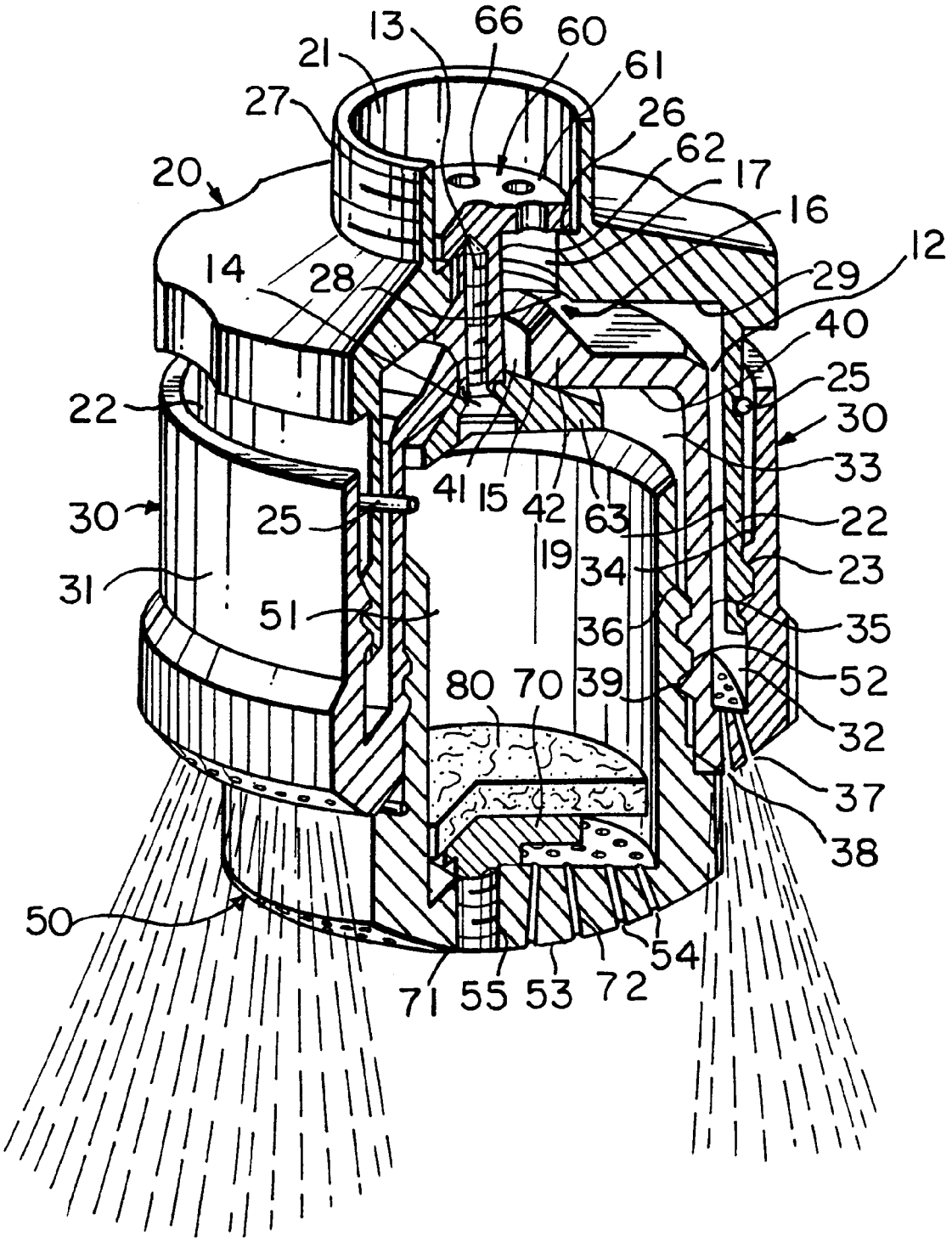
FIG. 2 The nozzle in its rinsing position; perspective view.

The distance between the base 29 of the nozzle 10 and the tapered back of the head 63 is suitably greater than the thickness of the base 40 of the sprayer 30 where its position corresponds with that of the tapered expansion 42. Therefore, by rotating said sprayer 30 axially, due to the effect of its thread 36 and of the thread 23 on the nozzle, said sprayer can be moved axially to the rinsing position in FIG. 2 or to the washing position in FIG. 3. In the rinsing position the sprayer is at the end of its stroke outside the nozzle 10.

Consequently, the lower edge 15 of the cylindrical hole 41 in the sprayer matches up with the tapered back of the head 63 of the flow deflector 60 closing access to the inner chamber 33 of the sprayer 30 and opening the passage 16 between the base 29 of the nozzle 10 and the top of the tapered expansion 42.

Therefore, having run through the hole 17 in the nozzle and through the holes 66 in the base 61 of the flow deflector 60, the water flows down the passage 16 and on through the cavity 12 between the sprayer 30 and the cup-shaped body 20, emerging from the set of holes 37, 38 in the bottom of said cavity.

Figure 3:
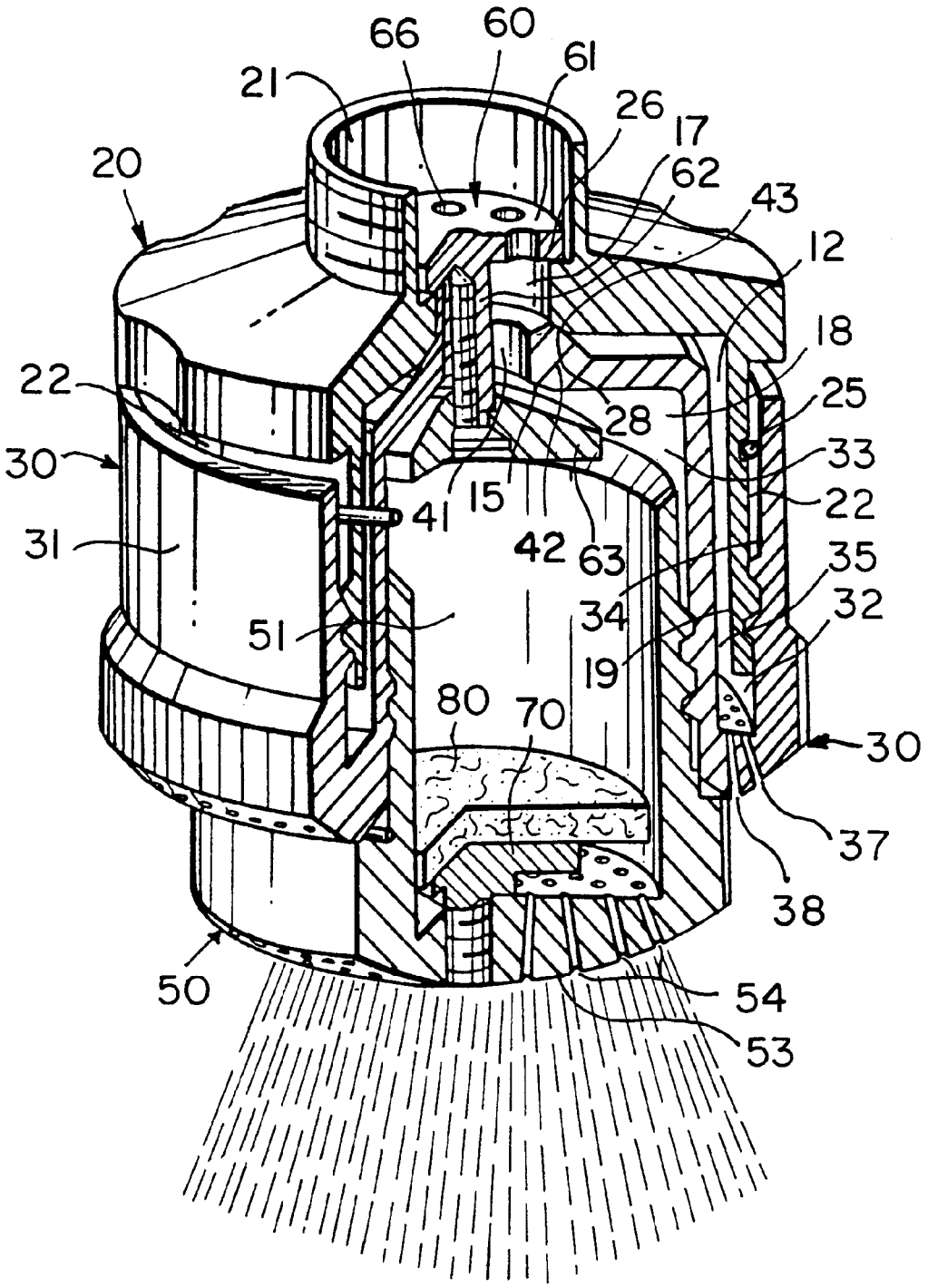
FIG. 3 The nozzle in its washing position; perspective view.

In the position seen in FIG. 3 the edge 28 of the hole 17 in the nozzle 10 is in contact with the upper edge 43 of the tapered expansion 42 and water from the pipe 11 can flow through the upper hole 41 in the sprayer, entering said sprayer's chamber 33 and then passing into the mixing chamber 51 in the head 50 from where, after dissolving the detergent product in tablet form 80, it flows out through the set of holes 54.

We claim:

1. Nozzle usable as a shower attachment, characterized in that it comprises a sprayer containing a mixing chamber and through which water passes, accessible from the outside for insertion of a quantity of detergent product for toilet purposes, a cylindrical cup-shaped body having a wall and an axial hole in a base, filtered uppermost with a collar and thread for screwing onto the end of a mains water pipe, the mixing chamber in the sprayer is formed as a cylindrical head which is provided with a bottom containing holes for a sprayed outflow of water and lodged in an inner chamber created by the cylindrical body of said sprayer to form around the cylindrical body an annular chamber open at the back of said sprayer into which annular chamber penetrates the cylindrical side of the body of said nozzle, the smaller diameter of said cylindrical side being greater than the diameter of a smaller wall of said annular chamber of the sprayer so that a cavity is formed for the passage of water in which there are holes for a sprayed outflow of water, there being in a sprayer base of the sprayer an axial tapered expansion facing towards the base of the body of the nozzle and the axial hole in which the axial stem of a flow deflector can freely pass, said deflector comprising an upper discoid base containing holes for the passing of water and a lower head with a tapered back of a diameter greater than that of the axial hole, connected to the base of the nozzle by said axial stem, said base resting on an annular seat round said axial hole in the cup-shaped body, the head with tapered back being placed inside the inner chamber, distance between the base of the cup-shaped body of the nozzle and the tapered back of said head on the flow deflector being suitably greater than the thickness of the base of the sprayer at the point corresponding to its tapered expansion so as to permit axial movement of the sprayer in relation to the cup-shaped body to regulate it, as desired, in one of the two positions here indicated respectively as 'washing' and 'rinsing', contact being made in the 'washing' position between the lower edges of the axial hole and the back of the tapered expansion at the sprayer base of the sprayer and opening of a passage between the lower edge of the axial hole in the sprayer and the tapered back of the head on the flow deflector and therefore entry of water, from the main pipe, that has passed through the holes in the discoid base of the flow deflector through the axial hole and through the axial hole in the sprayer into the sprayer chamber and then into the mixing chamber formed by the cylindrical head, flowing out through the holes at the bottom, already mixed with the detergent product placed in said mixing chamber, contact being made in the "rinsing" position between the lower edge of the axial hole of the sprayer and the tapered back of the head of the flow deflector and opening of a passage between the top of the sprayer and the base of the nozzle and then entry of water from the main pipe into the cavity and so its outflow through the holes in the base of said annular chamber without being mixed with the detergent product placed in the mixing chamber of the sprayer.

2. Nozzle (10) as in claim 1, characterized in that the toilet product (80) placed in the mixing chamber (51) in the sprayer (30) is in tablet form.

3. Nozzle (10) as in claim 1, characterized in that the sprayer (30) is connected to the nozzle (10) by a pair of threads of a short pitch and wide thread, respectively (23) on the outer cylindrical face of the nozzle and (36) on the larger face (34) opposite the annular chamber (32) of the sprayer (30) so that by turning the latter on its axis, said threads (23, 36) cause it to move axially.

4. Nozzle (10) as in claim 1, characterized in that the detergent product (80) is in powder form.

5. Nozzle (10) as in claim 1, characterized in that composition of a preferred type of detergent product (80) is substantially as follows:

Surface active agents 25%

Mineral salts 60–62%

Natural active ingredients 10–12%

Natural perfume 3%.

6. Nozzle (10) as in claim 1, characterized in that the formula of a preferred type of toilet product (80) contains some or all of the following components, percentages being substantially as indicated:

Empicol LZP 20%

Ammonyx 4002 3%

Sodium chloride FU 17%

Magnesium sulphate FU 20%

Magnesium chloride FU 10%

Potassium chloride 7%

Natural perfumes 3%.

* * * * *